US007218749B1

(12) United States Patent
Noponen et al.

(10) Patent No.: US 7,218,749 B1
(45) Date of Patent: May 15, 2007

(54) METHOD FOR SOUND REPRODUCTION AND PILLAR LOUDSPEAKER

(75) Inventors: Seppo Noponen, deceased, late of Nivala (FI); by Sisko Noponen, legal representative, Nivala (FI); Tapani Hintsala, Typpö (FI)

(73) Assignee: Anturilaakso Oy, Nivala (FI)

( * ) Notice: Subject to any disclaimer, the term of this patent is extended or adjusted under 35 U.S.C. 154(b) by 0 days.

(21) Appl. No.: 09/786,621

(22) PCT Filed: Sep. 17, 1999

(86) PCT No.: PCT/FI99/00767

§ 371 (c)(1),
(2), (4) Date: Mar. 5, 2001

(87) PCT Pub. No.: WO00/18180

PCT Pub. Date: Mar. 30, 2000

(30) Foreign Application Priority Data

Sep. 17, 1998 (FI) ..... 982007

(51) Int. Cl.
*H04R 11/02* (2006.01)

(52) U.S. Cl. ..... 381/431

(58) Field of Classification Search ..... 381/345, 381/351, 423, 186, 350, 431, 408; 181/148, 181/144, 153–157, 198–199, 145, 160
See application file for complete search history.

(56) References Cited

U.S. PATENT DOCUMENTS 4,385,210 A * 5/1983 Marquiss ..... 381/431
4,471,172 A * 9/1984 Winey ..... 381/427
4,792,978 A * 12/1988 Marquiss ..... 381/431
4,803,733 A * 2/1989 Carver et al. ..... 381/398
4,856,071 A * 8/1989 Marquis ..... 381/203
5,802,190 A * 9/1998 Ferren ..... 381/182
6,097,830 A * 8/2000 Zelinka et al. ..... 381/431
6,480,614 B1 * 11/2002 Denda et al. ..... 381/423

FOREIGN PATENT DOCUMENTS

EP 0048434 A1 3/1982
JP 59-086997 * 5/1984
WO 9905888 A1 4/1999

* cited by examiner

*Primary Examiner*—Vivian Chin
*Assistant Examiner*—Lun-See Lao
(74) *Attorney, Agent, or Firm*—Fildes & Outland, P.C.

(57) ABSTRACT

The invention relates to a method for sound reproduction and a loudspeaker, in which a vibrating diaphragm controlled by an operating device produces sound in the air surrounding it on the first side, and in which acoustic feedback is prevented by preventing the passage of the air over the edge of the diaphragm to its other side, and in which the air transports the sound to the surrounding free space. The diaphragm is formed as a uniformly vibrating, essentially straight and high element, so that the height H of the diaphragm is at least three times, and preferably at least five times its width W. Preferably, an essentially closed chamber is formed in front of the diaphragm, except for a narrow opening arrangement, in which one or more narrow openings essentially corresponding to the height of the diaphragm permit the passage of air and thus of sound from the enclosure to the free space.

11 Claims, 4 Drawing Sheets

Figure 1A:
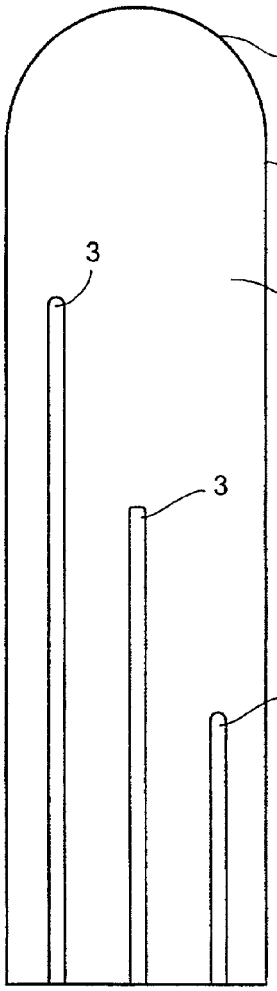

Fig.3a
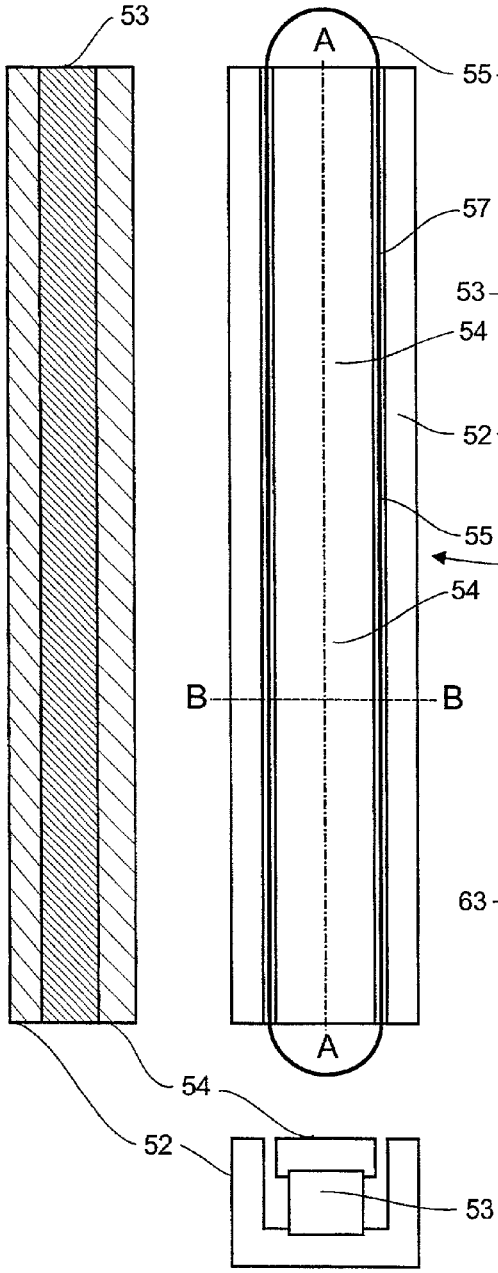
Fig.3b
Fig.3c
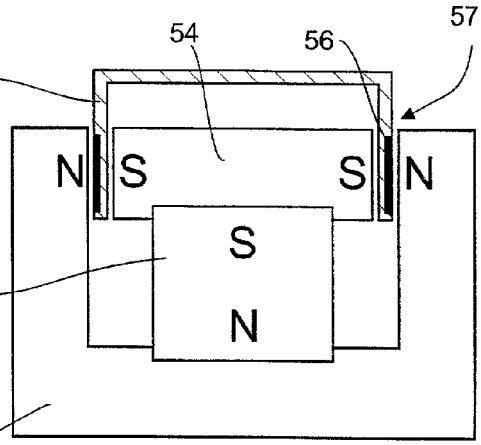
Fig.3d
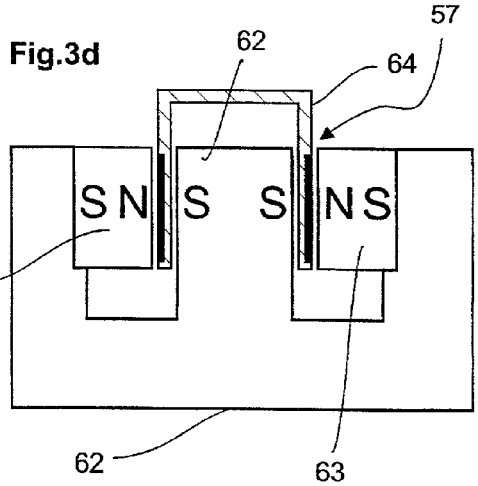

10
10
42
42
27
27
16
16
16
16
37

METHOD FOR SOUND REPRODUCTION AND PILLAR LOUDSPEAKER

The present invention relates to a method for sound reproduction and a dynamic pillar loudspeaker according to the preamble of claim 1.

A traditional dynamic loudspeaker produces acoustic sound in such a way that an electric signal corresponding to the sound it is wished to reproduce is brought from the amplifier to the mechanisms of the loudspeaker, when, for example, a cone or diaphragm, which is connected to a magnetic voice coil acting as an operating device, moves backwards and forwards in synchronization with the signal. The movement of the diaphragm then produces an acoustic soundwave, which proceeds into the surroundings as an audible sound. The diaphragm effectively can transmit the mechanical vibratory movement of the voice coil as a movement, i.e. as a soundwave, to the surrounding air, because its surface area is large in relation to the voice coil.

Traditionally and generally, if the loudspeaker is to be capable of good sound reproduction, the loudspeaker cone or diaphragm and the components connected directly to it should be light and easily moved. This is particularly the case in the treble range, in which the sound frequencies are large and loud sounds require great acceleration of the diaphragm. On the other hand, a diaphragm creating sounds with bass frequencies should generally be large and its operating device correspondingly powerful, which in turn requires that the voice coil forming the traditional operating device is strong and has a high resistance to heat. This problem is generally solved by using a band-division filter in the construction of the loudspeaker and two or more loudspeaker elements of different sizes, each producing only sounds within its own reproduction frequency band. These are referred to as bass (woofer), midrange (squawker), and treble (tweeter) elements.

A traditional loudspeaker element includes a paper cone, which is thin and soft and suspended softly in the element body by means of rubber seals and spiders. Therefore, the velocities and accelerations of the cone are limited according to the forces of mass, buckling, and stiffness, which are also affected by the air pressure in, and the volume of the loudspeaker cabinet. In addition, detrimental deflection, compression, and surface waves attempt to proceed in the cone, these being discernable as distortion components in the sound produced by the loudspeaker.

The cone of a conventional loudspeaker element is a funnel, producing a horn-shaped sound lobe, so that its sound pressure depends greatly on location. As a result, the sound field is even only over a small area. If the listeners are all on the same level, but spread over a large area, the sound field must cover this entire area. The sound field can be extended by either increasing the number of loudspeakers or by directing the sound from the loudspeakers in a horizontal plane. These factors have resulted in the creation of the traditional pillar loudspeaker. In it, two or more loudspeaker elements are set sequentially vertically in the same cabinet, as disclosed, for example, in U.S. Pat. No. 5,802,190. When they operate in phase with each other, the reinforce each other in the horizontal plane, but weaken each other in the vertical plane, so that a pillar loudspeaker produces a broad, but low sound lobe.

In public buildings, in which there are usually simultaneously both a live speaker and sound reproduction, problems arise, for example, in relation to feedback sensitivity and suitable acoustics. This is particularly the case, if music is also played in the same premises, as this demands a longer post-echo time than speech or speech reproduction. In this case, the reproduced speech becomes more difficult to understand. In high rooms, such as churches, ceiling reflections can also cause detrimental resonances. Even in high rooms, all the listeners are usually at the same level, but spread over an extensive area, so that the energy of the loudspeakers must be directed over the same area.

The invention is intended to eliminate the defects in sound reproduction, particularly in public buildings. The intention is to create a loudspeaker, which will produce an extensive and even sound lobe, i.e. local sound field, with a sound pressure that varies only slightly as a function of location. A method for sound reproduction, in which a vibrating diaphragm controlled by an operating device produces sound in the air surrounding it on the first side, and in which so-called acoustic feedback is prevented by preventing the passage of the air over the edge of the diaphragm to its other side, and in which the air transports the sound to the surrounding free space, is characterized in that the diaphragm is formed as a uniformly vibrating, essentially straight and high element, so that the height H of diaphragm is at least three times, and preferably at least five times its width W, and that an essentially closed chamber is formed in front of the diaphragm, except for a narrow opening arrangement, in which one or more narrow openings essentially corresponding to the height of the diaphragm permit the passage of air and thus of sound from the chamber to the free space.

The pillar loudspeaker is intended for sound reproduction indoors and outdoors. The pillar loudspeaker includes a cabinet construction supporting a diaphragm, at least one operating device for driving the diaphragm, which is operationally a straight, unified, and relatively stiff single component, which is tall vertically and narrow horizontally in such a way that the height H of diaphragm is at least three times, preferably five times greater than its width W, and in which the diaphragm is arranged to vibrate mechanically by means of the force of operating device to produce a sound in the free space. The cabinet construction is arranged to prevent acoustic feedback in such a way that the cabinet construction encloses one side of the diaphragm, the other side has an air connection to the free space, and is characterized in that the loudspeaker includes a narrow opening arrangement, comprising at least one narrow opening in front of the diaphragm in the construction forming chamber and leading away from the chamber, to allow air to pass from the chamber to the free space. As such, a high diaphragm directed to an unrestricted space will not offer many advantages, but, if a narrow opening arrangement according to the invention is added to this, an entirely new type of loudspeaker will be created. In principle, each point on a unified loudspeaker diaphragm is an independent and dynamic source of sound. If these diaphragm points move in phase with one another, each one of them will also, in principle, send a soundwave in phase to the surrounding space. The chamber forms a pressure chamber and the narrow opening in it forms an acoustic load on the diaphragm and an effective source of sound. The sound coil of the loudspeaker compensates for the increase in the intensity of sound determined by the sum factors of the distance laws, if the listener moves closer to the loudspeaker. Correspondingly, if the listener moves farther from the loudspeaker, the sound lobe will compensate for the drop in the volume of sound, because the relative differences in distance between the different points on the loudspeaker diaphragm will diminish. The sound field of an entire auditorium can be controlled by means of the new pillar loudspeaker system. In it, each loudspeaker dominates its own vicinity, without interference from neighbouring loudspeakers, for instance. This also means that there is no need to use delays in a system constructed with the new pillar loudspeakers, regardless of whether the sound reproduction system is used indoors or outdoors.

There are several differences in principle between a pillar loudspeaker according to the invention and a traditional pillar loudspeaker, such as:

- the sound-producing diaphragm is a single and unified component, each point on which is, in principle, its own source of sound,
- the diaphragm is narrow and high, because the desired sound lobe of the loudspeaker is broad in the horizontal plane and narrow in the vertical,
- the diaphragm is controlled by a traditional or a new operating device, in which there may be one or more operating device units, such as magnetic voice coils or other units,
- the loudspeaker cabinet can be of any desired design and the loudspeakers can be made to suit the room,
- the active components of the loudspeaker are assembled in a separate module,
- there can be different loudspeaker modules for different purposes,
- the modules can be used either facing the wall or facing the listeners,
- the loudspeaker or module is preferably equipped with an acoustic load, either with or without the narrow opening arrangement referred to later,
- the acoustic load also acts as a protection, lobe director, design factor, etc.,
- the module can be installed in a recess in a wall, in which case the wall can act as an auxiliary space,
- the pillar loudspeaker can be located acoustically correctly at listener level and without disturbing the listeners,
- a reproduction system built around the pillar loudspeaker can easily be adapted,
- pillar loudspeakers will withstand being handled by an audience without being damaged,
- the acoustic energy of a pillar loudspeaker is mainly concentrated only at listener level,
- a sound reproduction system implemented using pillar loudspeakers does not require delay lines.

The most important difference between a traditional pillar loudspeaker and one according to the invention is that the latter has only a single sound-producing narrow opening, which is high vertically and narrow horizontally. The height of the diaphragm is generally many times its width. Practicality will set the upper limit. It is possible to imagine a diaphragm as much as 5 m high and 50 mm wide. The diaphragm is controlled by an operating device, which usually comprises one or more magnetic voice coils or other operating device units. The operating device always controls the entire active surface of the diaphragm in phase, so that it does not create lobe folds in the sound field in the same way as a multi-element traditional loudspeaker. In the same way, there are no great discontinuities in the acoustic impedance as a function of frequency.

The second significant difference to a traditional pillar loudspeaker is that the dynamic components of the loudspeaker are assembled in a module, which can be installed in a cabinet of a desired design, which can be suspended, e.g., from a wall, or set directly into, e.g., an opening in a wall, or behind it. This method gives freedom of design, implementation, and location in sound reproduction solutions and accelerates them. An advantage in the loudspeaker module being manufactured as a separate module is that it can be quickly attached to another ready-made construction. In certain embodiments, the chamber and the narrow opening are only formed when the loudspeaker is installed in a wall. Thus, there can then be various standard products, into which the module will fit. The production process is simplified and the need to transport components is reduced.

The third significant difference to a traditional pillar loudspeaker is that a loudspeaker according to the invention is usually installed on a wall with the loudspeaker diaphragm facing the wall, in other words, the diaphragm is between the cabinet and the wall. In this case, the narrow opening between the wall and the cabinet creates an acoustic load on the loudspeaker. Usually, this narrow opening is so small, that fingers cannot penetrate it. When installed in this way, the loudspeaker will withstand being handled from the listener side, because the more fragile diaphragm is protected. The loudspeaker can be located acoustically correctly, sufficiently low down and close to the listeners, who are preferably situated in the direct sound lobe and field. When only a module is used, it can be installed directly in a recess in a wall, either with or without the aid of an acoustic load. The loudspeaker diaphragm of the new loudspeaker is a rather thin, stiff plate or moulded shape, which produces a broad-lobed sound in the horizontal plane and a narrow-lobed sound in the vertical plane. The loudspeaker is intended for the entire range of sound, but its reproduction range depends on the embodiment. The loudspeaker diaphragm will withstand normal handling, installation, and use. Modifications to the loudspeaker diaphragm will achieve desired objectives, such as evenness of the reproduction curve, variations in sensitivity, damping, protection, design requirements, etc. The loudspeaker diaphragm is suspended in a separate body unit or module, which is, in turn, installed either in a cabinet or directly in a wall. A loudspeaker with a cabinet is usually installed as a surface installation on a wall, so that the module and diaphragm face the wall. In such cases, the opposite side of the loudspeaker cabinet forms a facade facing the audience, and can be designed to suit the room in which it is wished to install it.

In the following, the construction and operation of a loudspeaker according to the invention are explained in greater detail verbally and also with reference to diagram drawings of the loudspeaker. The following diagram and construction drawings relate to a closer examination of pillar loudspeakers equipped with different types of modules, from which it will be seen that FIG. 1*a*) shows a diagram of the pillar loudspeaker from in front (facade), b) shows a diagram of the pillar loudspeaker from the rear, i.e. diaphragm side, c) shows a cross-section of the pillar loudspeaker along its centre-line A—A, d) shows a cross-section B—B of the loudspeaker at the operating device unit, FIG. 2*a*) shows an example of a loudspeaker module installed in a wall cavity with its facade plate removed, b) shows a cross-section A—A on the centre-line of the previous installation, c) shows one third example, in which there is an open acoustic load (narrow opening) in the centre of the loudspeaker module, FIGS. 2*d* and 2*e* show cross-sections of FIGS. 2*b* and 2*c*, FIG. 3*a*) shows a cross-section A—A of the new operating device in FIG. 3*b* b) shows a diagram of a new loudspeaker operating device from the front, c) shows an enlarged cross-section B—B of the new operating device in FIG. 3*b*, and d) shows a cross-section of a different type of magnet arrangement.

Figures 4A, 4B, 4C, 4D:
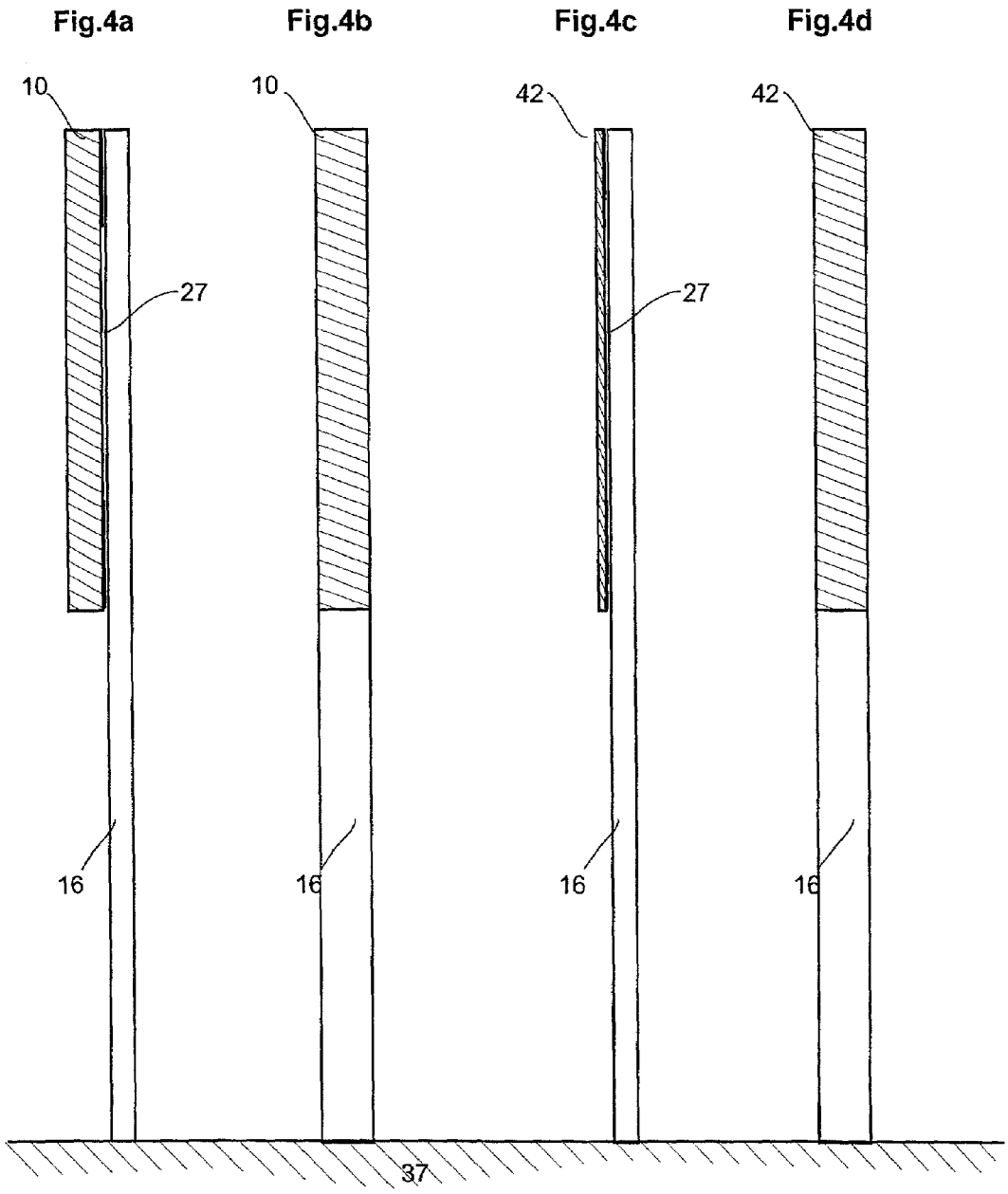

FIGS. 4*a* and 4*b* shows a loudspeaker installed on a post, corresponding to the examples in FIGS. 1*a*–1*d*.

Figure 2A:
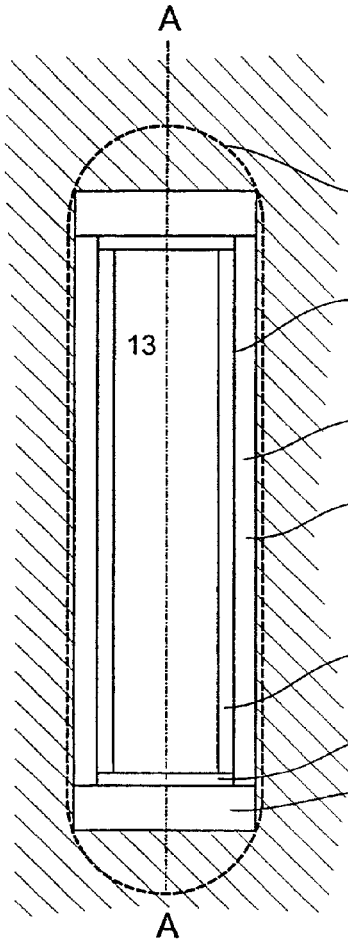
Figure 2B:
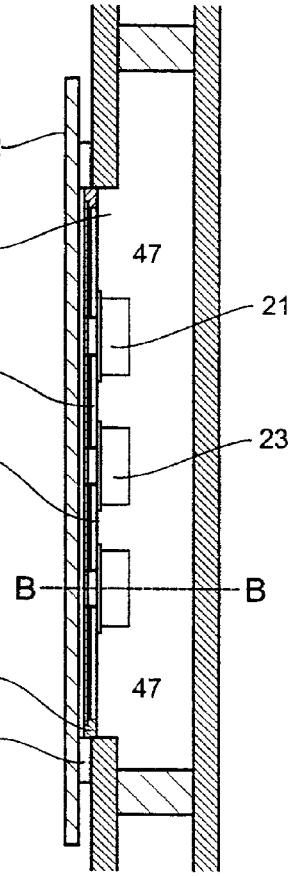

FIGS. 4*c* and 4*d* shows a loudspeaker installed on a post, corresponding to the examples in FIGS. 2*a*–2*b*.

FIG. 1*a* shows the facade of a wall-installed pillar loudspeaker, the cabinet 1 of which, designed as desired, is made of MDF-board, or some other suitable material. The material of the cabinet should be stiff enough to ensure that its natural resonances do not interfere with the sound reproduction of the loudspeaker. Machining or moulding technology can be used to construct the cabinet. The facade 2 of the cabinet can have aesthetic details and constructions 4, while its shapes can be designed as desired. The width and depth of the cabinet will affect the shape of the sound lobe, while the volume of the cabinet will mainly affect low-frequency reproduction sensitivity.

Figure 1B:
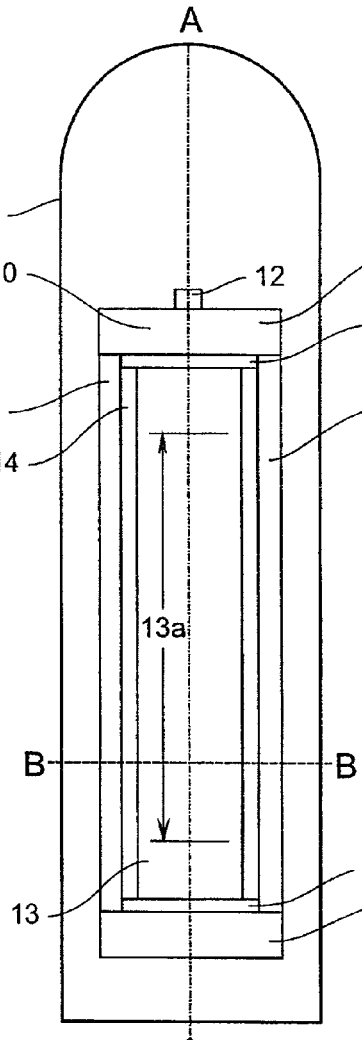

FIG. 1*b* shows the same loudspeaker from the rear. Compacted module 10 is installed in the cabinet opening 8, the module being standard and in the desired cabinet, designed for the aesthetic requirements of the reproduction room. There can also be various types of standard module, to meet, for example, different output, sound reproduction, and spatial requirements. Installed inside the body 11 of the module are the active and other components relating to sound reproduction, such as loudspeaker diaphragm 13 installed with the aid of diaphragm seals 14 and end pieces 15, wall attachments 16 for suspending the loudspeaker, socket 12 for connecting the amplifier, and an operating device, which is installed in body 11 inside cabinet 1, and which converts the electrical energy of the amplifier to mechanical vibratory movement in the diaphragm 13. The height 13*a* of module 10 and the moving part of its diaphragm 13 determine the directivity of the vertical place of the sound lobe. As the location of module 10 can be altered mainly vertically in relation to cabinet 1, the location of the source of sound can vary, even though the loudspeaker, which for example is attached to a wall, is not moved.

The flexible suspension of loudspeaker diaphragm 13 permits sufficient movement in the diaphragm for the desired sound pressure. Instead of end piece 15 of diaphragm 13, it is also possible to use some other sealing piece that acts linearly. This will keep diaphragm 13 oriented in relation to the operating device while permitting movement in the diaphragm. Various types of joint, hinge, or bending component can also be used to help to suspend and direct the diaphragm. The end of diaphragm 13 may also incorporate a structurally flexible zone, which replaces the separate piece 15. This can be made by, for example, reducing the thickness of the diaphragm in the vicinity of its end. Connector piece 15 also permits a slight longitudinal movement in diaphragm 13, assisting the movement of the diaphragm and thus sound production.

The loudspeaker diaphragm 13 may be curved, flat, concave, or shaped and sufficiently stiff so that it will withstand even powerful bass sounds. The external appearance of the diaphragm is almost a rectangle, the height of which is at least three times that of its width. In special embodiments, the diaphragm can even be several meters high. In principle, diaphragm 13 comprises one or two narrow channel strips, which is glued or moulded to material between to form a stiff layered structure. The surface material can be aluminium, carbon fibre, kevlar, or other suitable material, the material between being balsa, foam plastic, felt, etc. Diaphragm 13 is finished as desired, for example, by painting, surfacing with rubber, etc.

Loudspeaker diaphragm 13 should move sufficiently over a surface area corresponding to the desired frequencies, producing the desired sound pressures in a certain lobe and state of reproduction. The machining, component gluing, laminations, and mouldings, as well as surfacings, required by sound reproduction can be carried out on diaphragm 13, either during the construction of the diaphragm, or later. These can include grooving, perforations, infilling, thinning, recessing, or stiffenings that limit and damp deflection, such as structural components and shapes that are left raised. In addition, the flexibility and constructional technique of diaphragm 13 can be altered as required by the sound reproduction properties, according to the voice coil distance or the active principle of motion of the diaphragm. In some embodiments, it may be necessary to use certain additional constructions, such as separate dampening materials or structures in the cabinet, to improve the efficiency, sensitivity, output resistance, or other properties of the loudspeaker. In addition, diaphragm 13 is constructed in such a way that it moves in its entirety at low reproduction frequencies, but when the reproduction frequency increases, the vibrating area of the diaphragm diminishes correspondingly, until at the upper treble frequencies the only areas that vibrate are those to which the motion of the voice coil is directly connected.

Figure 1C:
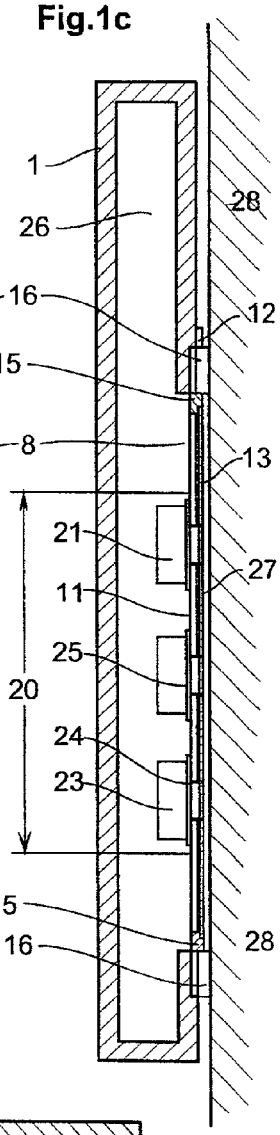

FIG. 1*c* shows a cross-section on centre-line A—A of pillar loudspeaker 1, in which the loudspeaker is suspended from wall 28 by means of wall attachments 16. The special feature in this case is that loudspeaker diaphragm 13 is set in the cabinet to face the wall, and not to face the listeners, as is usually the case. This arrangement particularly intended for the sound reproduction requirements of public rooms, where a sufficiently broad and even sound field can be created in an auditorium by means of several similar pillar loudspeakers. Loudspeaker cabinet 1 is set at a suitable distance from the wall, so that loudspeaker diaphragm 13 cannot be touched while installation wall 28 forms a suitable acoustic load for loudspeaker diaphragm 13. This affects the tuning of the loudspeaker, the reproduction area, and the lobe properties. Loudspeaker diaphragm 13 is relatively close to the wall, but, even at the greatest diaphragm amplitude, diaphragm 13 does not touch wall 28. The loudspeaker lead from the amplifier enters the loudspeaker through socket 12, which is either surface-mounted or sunk. The figure shows the internal volume 26 of the loudspeaker, which has a central effect on the lower boundary frequency of the loudspeaker.

The cabinet filling is usually mineral wool and also absorbs the acoustic reflections of the cabinet. The vertical height 13*a* of the moving loudspeaker diaphragm 13 determines the range of the sound lobe in the horizontal plane, which must be taken into account as the sound field requirement of the loudspeaker. In practice, this vertical height is slightly greater than the length of operating device 20, due to structural and inertia factors in the diaphragm. The same factors increase the active surface area of diaphragm 13 when reducing the frequency, even though the diaphragm of the pillar loudspeaker is narrow. It must be noted, that in embodiments in public rooms intended for the reproduction of speech, when the person speaking and the loudspeakers are in the same room, a pillar loudspeaker need not produce frequencies of less than 100 Hz, as this might otherwise reduce the comprehensibility of the reproduced speech.

The properties of operating device 20 are determined by the type, output, directivity, or carrying power of the loudspeaker. It will be seen from FIG. 1*c* that operating device 20 comprises, for example, three conventional voice coils 21 or other operating device units. The mutual electrical connections of the voice coils can also be switched between series and parallel connections, according to the frequency range, impedance, sensitivity, and lobe requirements. If there are several conventional voice coils 24 in the operating device, each of them is connected mechanically from a small area to the centre-line of diaphragm 13. In this case, if the frequency and intensity increase sufficiently, push-pull areas may be created in the diaphragm, both permitting detrimental drops in the sound pressure of the loudspeaker at the frequencies in question and there are the appearance of phase errors or lobe folds in the sound lobe, in the treble range.

Figure 1D:
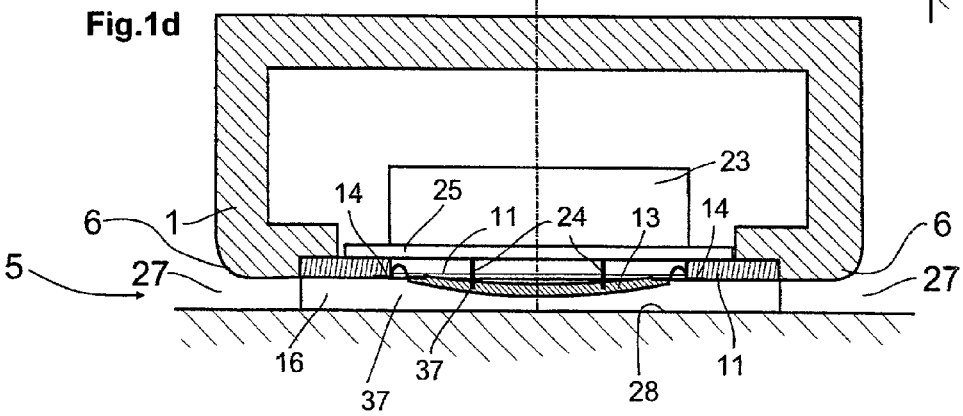

FIG. 1*d* shows an enlarged cross-section B—B of pillar loudspeaker 1 at magnetic voice coil 24, when the loudspeaker is suspended from wall 28 by means of suspension piece 16. Though in this case the surface of cabinet 1 is set parallel to the surface of the wall, the adaptation of the suspension devices will permit its installation at an angle to the wall, leaving a narrow opening only at one edge, with the other edge closed.

Magnetic voice coil 24 is one part of operating device 21, which moves diaphragm 13. Voice coil 24 is connected to the diaphragm either directly or else by means of an intermediate component, i.e. a diaphragm seat. Magnet 23 is suspended in module body 11 by means of a magnet bridge 25, which also centres the narrow opening of magnet 23 of voice coil 24. Diaphragm 13 is suspended in module body 11 from its edges by means of flexible seals 14. An enclosure 9 is formed between the wall surface 28 and cabinet 1 at diaphragm 13, from which the sound lobe discharges to the environment from the narrow openings 27 between the loudspeaker and the wall surface. These narrow openings 27 form an important narrow opening system 5 from the point of view of the operation of the loudspeaker. If an asymmetrical sound lobe is desired, the sound lobe can be oriented by blocking one of the narrow openings 27 in a controlled manner, in which case the sound will only be discharged through the other narrow opening, as in an angled installation. Thus, the sound lobe can be directed, even after the installation of the loudspeakers. The direction is also influenced by factors such as the bevelling (radius 5–30 mm) of the rear edges 6 of the sides of the cabinet, which also affect the local lobe diffractions in the upper treble range. Because a loudspeaker diaphragm 13 installed in this way is in a small space between the side narrow openings 27, diaphragm 13 is connected to the surroundings by means of a short transfer line. The air velocity in it increases, especially at low frequencies, due to the effect of the diaphragm movement. Chamber 9 and narrow opening 27 create a slight horn effect. The width d of narrow opening 27 is 12–30%, preferably about 20%, of the width W of diaphragm 13. The greatest depth of the chamber is of the same order.

Generally, spiders are not needed to centre the magnet of the voice coil, because the diaphragm is stiff. Normally, the voice coil is glued to the diaphragm's 13 recess or seat 37, in which there are also leads from the amplifier socket 12 of body 11. There may also be a movement limiter in diaphragm 13, which prevents excessive amplitudes of movement in the diaphragm. On the other hand, even the seal and suspension construction may act as a sufficient limiter. If, for example, a spider construction is used in a large output loudspeaker, it can be assembled from lever-like or joint components, which not only perform the aforementioned centring and connections, but also prevent the lateral vibration of the voice coil.

In principle, diaphragm 13 is a linear source of sound. For example, it is stiffened in such a way that a filler material between two curved and hard surfaces separates the surfaces from each other. The filler material can be, e.g., paper, balsa, urethane, styrox, or a composite material. The support construction of diaphragm 13 can be of a desired shape. The thickness, mass, and other details of the construction of diaphragm 13 are determined by the desired reproduction characteristics. Between module body 11 and diaphragm 13, there may also be a damper, e.g., cloth, wool, cotton-wool sheet, cellular rubber, foam plastic, which acts as a tuning element against the diaphragm to damp its vibrations.

Diaphragm 13 is preferably a composite, moulded, or laminated construction, made of aluminium, kevlar, carbon-fibre, urethane, or wood fibre.

FIG. 2*a* shows an embodiment of a loudspeaker according to the invention, in which the 'design' cabinet is replaced by, e.g., a wall as the place of installation of the loudspeaker module 10. Module 10 is sealed into, e.g., wall opening 40 or behind it, with diaphragm 13 outwards, so that the loudspeaker construction is closed. The volume of the loudspeaker then becomes part of the wall, because the diaphragm narrow opening in module body 11 permits a flow of air behind diaphragm 13 into the wall structure, in which case, e.g., the low-frequency sensitivity increases. In such a case, the acoustic load to be set in front of diaphragm 13, i.e. the protector and facade board 42, also acts as a lobe director and, along with the diaphragm dimensions and the amplitude of movement, affects the sound reproduction characteristics of the loudspeaker.

FIG. 2*b* shows a cross-section along the centre-line of a module installed in the above wall opening 40. In the backing space, i.e. in wall construction 47, there are generally damping materials, which affect the sound reproduction characteristics of the loudspeaker. In the figure, the module is installed in front, on top of the opening in the wall board. FIG. 2*d* shows a cross-section of the installation. The figure does not show the bevelling of the edges of narrow opening 27, which are only of significance at high frequencies.

Figure 2C:
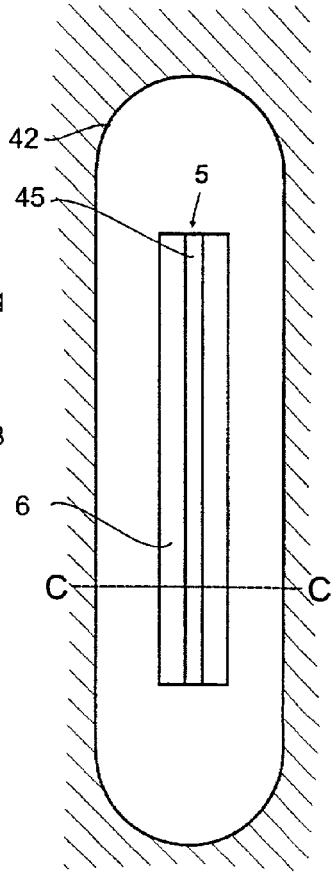
Figure 2D:
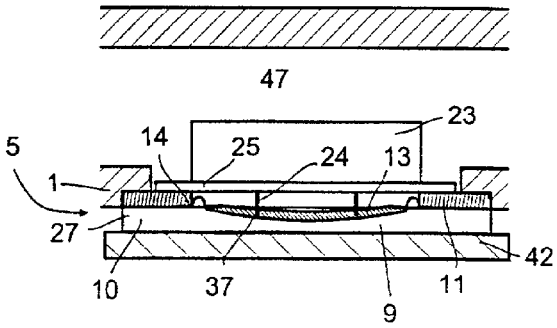
Figure 2E:
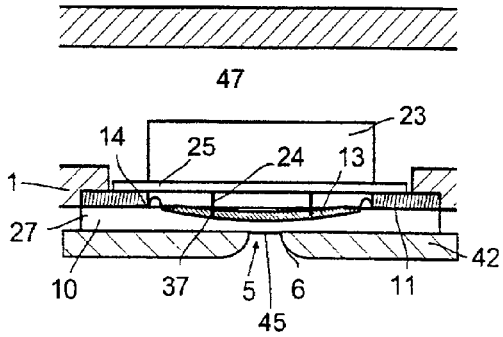

Module 10 can also be sunk into the opening. If the installation has been carried out behind the board, for example, when the boarding has been installed, the acoustic load can be at the level of the wall board, so that the loudspeaker can hardly be distinguished from the wall. This is particularly the case, if the acoustic load is a board with a narrow opening, as shown in FIG. 2*c*, for instance, sturdy anodized aluminium strip. FIG. 2*c* shows a preferred embodiment of loudspeaker 1. In FIG. 2*c*, there is a desired acoustic design load, which is in the wall opening on top of the loudspeaker module. In front of loudspeaker diaphragm 13 is a narrow opening 45, i.e. a board piece equipped with an acoustic load opening 45, a facade board 42, which can also be its installation board, panel, etc. Together with diaphragm 13 and the module seal, this forms a nearly closed space (except for narrow opening 45). Body 11 is closed, so that the operation of the loudspeaker is the same as in the previous case. As a result of load 42, the acoustic impedance of diaphragm 13 increases, when diaphragm 13 is dynamically pressurized. Thus, when the loudspeaker operates, air flows from its narrow opening 45, particularly at low frequencies depending on the volume, when the velocity of the air increases and the efficiency of the loudspeaker also increases. This creates an advantage, in that a small loudspeaker construction can produce powerful low reproduction frequencies. In addition, the loudspeaker directs the sound, according on its dimensions. The construction of the pillar loudspeaker may include other acoustic elements and guides, which affect the frequency reproduction and tuning.

FIG. 2*e* shows a cross-section of example 2c. The entire construction can also easily be imagined as being in an independent cabinet, either standing on the floor or hanging from the ceiling.

In FIGS. 4*a* and 4*b*, the pillar loudspeaker is installed on a pole. The independent cabinet 10 forms a narrow opening 27 with the side of the pole. Correspondingly, in FIGS. 4*c* and 4*d*, the pillar loudspeaker is installed inside the pole. Facade board 42 forms a narrow opening 27 with the side of the pole 16.

FIG. 3*a* shows a cross-section A—A of the new operating device of pillar loudspeaker 1, i.e. of linear operating device 50, which is long and thus suitable for controlling the diaphragm 13 of a loudspeaker according to the invention. It does not create push-pull phase areas in diaphragm 13 even at treble frequencies, because it operates in phase over its entire length. The linear operating device 50 is entirely connected to diaphragm 13, so that it is evenly loaded. The construction of operating device 50 is due to the long and narrow magnet connecting strap 54, and the corresponding magnet arrangement 52, which preferably comprises several neodym magnets 53. Because these magnets are small in relation to their energy content, slim and even small loudspeakers can be constructed with the aid of an operating device according to the invention.

FIG. 3*b* shows linear operating device 50 seen from in front. It shows magnet body 52, magnet connecting strap 54, on either side of which are glued suitable neodym magnets 53. The voice coil 55 is set around magnet connecting strap 54 in narrow opening 57 and is centred so that it does not make contact with the magnet arrangement.

FIG. 3*c* shows cross-section B—B of the linear operating device. The voice coil comprises an aluminium body 55 and a copper coil 56 glued to it. The aluminium body is made from extruded section or by edging sheet aluminium. Thus it has a large thermal capacity, so that the construction is also well suited to high-power loudspeakers. FIG. 3*d* shows an example of a linear operating device with a voice coil 64 that is even smaller than the previous one. It has two neodym magnets 63, so that the construction does not have a separate connecting strap.

The following points can be made in connection with the linear operating device:

Vortices arise in the narrow opening of a moving conducting metal magnet, and tend to resist the movement of the voice coil when it is producing sound (especially when it is connected to the diaphragm).

There are several good and appropriate materials for making the body of the voice coil, such as capton, aluminium, traditional pressboard, cardboard or paper, and suitable plastics.

Vortices can be prevented by the following means:

the body of the voice coil can be made from non-conducting materials, such as capton, ceramics, plastics, composite materials, carbon-fibre (with the fibre arranged to be non-conducting), kevlar, etc.

if the body is made from a conducting material, e.g., aluminium, it can be made thin, in which case the effect of the vortex diminishes, or by making saw or file cuts in the body, which prevent the current circuits of the electromotive forces arising at the air connecting narrow opening in the body from closing outside the air connecting narrow opening.

if the body is made from a conducting material, such as aluminium (a good thermal conductor), in addition to the above, the body can be constructed using a laminating technique, so that long flow loops do not arise.

the body of the voice coil can be ended before the air connecting narrow opening, so that the voice coil that is actually in the air connecting narrow opening is glued (e.g., with ceramic material) to the body, so that the potentials referred to do not arise.

The invention is not limited to the embodiments disclosed above, as these can be varied within the scope defined by the Claims. Thus, for example, diaphragm 13 need not be flat, but can include other shapes or be part of the rest of the construction. The flexible edge permits even the large amplitudes of movement in the diaphragm, which are required when producing low and powerful bass sounds. Nonetheless, even the flexible edge can be of the same material or component as diaphragm 13. Thus, the flexible edge can be constructed either in the diaphragm material or can be a separate component of a different material. The diaphragm material can be preferably selected from many appropriate and durable materials, such as fibreboard, woven materials, plastics, composite materials, and even metals.

What is claimed is:

1. A pillar loudspeaker intended for sound reproduction indoors and outdoors, which pillar loudspeaker includes an essentially closed chamber with a passage to free space to allow air to pass from the chamber to the free space, a cabinet construction supporting a diaphragm at one side of the chamber, at least one operating device for driving the diaphragm, which is operationally a straight, unified, and relatively stiff single component, which is tall vertically and narrow horizontally in such a way that the height H of said diaphragm is at least three times greater than its width W, and in which the diaphragm is arranged to vibrate mechanically by means of the force of said operating device to produce a sound in the free space, the cabinet construction being arranged to prevent acoustic feedback by enclosing one side of said diaphragm within it, the other side having an air connection to the free space, and a facade board that includes one elongated, narrow, non-circular opening opposing the diaphragm in the chamber, the opening being high vertically and narrow horizontally.

2. A pillar loudspeaker according to claim 1, characterized in that said diaphragm is placed at the side of said cabinet, which is arranged to be installed with attachment devices at a distance from and facing a wall surface, at least one narrow opening being formed between an edge of the side of said cabinet and wall surface.

3. A pillar loudspeaker according to claim 1, characterized in that the cabinet construction includes an enclosure construction enclosing said diaphragm, in which enclosure there is a narrow opening on the side opposite said diaphragm.

4. A pillar loudspeaker according to claim 1, characterized in that the width d of said narrow opening is 12–30% on the width W of said diaphragm.

5. A pillar loudspeaker according to claim 1, characterized in that the loudspeaker includes several point-like operating devices and that said diaphragm has a curved cross-section, to stiffen it.

6. A loudspeaker according to claim 1, characterized in that the loudspeaker includes one or more high linear operating devices.

7. A loudspeaker according to claim 1, characterized in that said diaphragm comprises a composite material, molded, or laminated construction, its material being aluminum, kevlar, carbon-fibre, urethane, or wood fibre.

8. A loudspeaker according to claim 6, characterized in that a voice coil element, which moves in an air connecting narrow opening of the body of a said linear operating device and is elongated in its circumferential plane, is attached either directly or indirectly to the base of said diaphragm.

9. A loudspeaker according to claim 8, characterized in that the body of said linear operating device is a unified component, which forms two high narrow openings between the magnetic poles, with a high voice coil being fitted into these narrow openings.

10. A loudspeaker according to claim 9, characterized in that the body of said high voice coil is made from aluminum.

11. A pillar loudspeaker intended for sound reproduction indoors and outdoors, which pillar loudspeaker includes an essentially closed chamber with a passage to free space to allow air to pass from the chamber to the free space, a cabinet construction supporting a diaphragm at one side of the chamber, at least one operating device for driving the diaphragm, which is operationally a straight, unified, and relatively stiff single component, which is tall vertically and narrow horizontally in such a way that the height H of said diaphragm is at least three times greater than its width W, and in which the diaphragm is arranged to vibrate mechanically by means of the force of said operating device to produce a sound in the free space, the cabinet construction being arranged to prevent acoustic feedback by enclosing one side of said diaphragm within it, the other side having an air connection to the free space, wherein the passage includes two opposed, elongated, narrow, non-circular openings on opposite sides of the cabinet construction wherein the diaphragm is generally in the middle, each opening being high vertically and narrow horizontally.

* * * * *